United States Patent [19]

Huang

[11] Patent Number: 4,905,130

[45] Date of Patent: Feb. 27, 1990

[54] FLASHLIGHT ASSEMBLY

[76] Inventor: Tien-Tsai Huang, No. 4, Lane 30, Wu-Chuan St., Pan-Chiao City, Taiwan

[21] Appl. No.: 259,708

[22] Filed: Oct. 19, 1988

Related U.S. Application Data

[63] Continuation-in-part of Ser. No. 895,456, Aug. 11, 1986, Pat. No. 4,750,095.

[51] Int. Cl.[4] ..... F21L 7/00

[52] U.S. Cl. ..... 362/203; 362/196; 362/205

[58] Field of Search ..... 362/196, 203, 190, 202, 362/204, 205

[56] References Cited

U.S. PATENT DOCUMENTS

| | | | |
|---|---|---|---|
| 916,833 | 3/1904 | Blau | 362/203 |
| 1,403,707 | 1/1922 | Quarnstrom | 362/396 |
| 2,540,683 | 2/1951 | MacLean . | |
| 2,550,233 | 4/1951 | Duncan | 175/183 |
| 2,687,508 | 8/1954 | Noyes | 324/53 |
| 2,736,793 | 2/1956 | Raymond | 362/203 |
| 2,797,309 | 6/1957 | Dulberg | 362/203 |
| 2,816,215 | 12/1957 | Jarred | 362/203 |
| 3,876,970 | 4/1975 | Schweitzer | 362/205 |
| 3,885,148 | 5/1975 | Di Benedetto | 362/203 |
| 4,225,907 | 9/1980 | Erdell | 362/255 |
| 4,286,311 | 8/1981 | Maglica | 362/205 |
| 4,333,129 | 6/1982 | Ewing | 362/205 |
| 4,399,496 | 8/1983 | Lergacher | 362/205 X |
| 4,504,890 | 3/1985 | Chan | 362/203 |
| 4,546,416 | 10/1985 | Pemberton | 362/84 |
| 4,577,263 | 3/1986 | Maglica | 362/187 |
| 4,658,336 | 4/1987 | Maglica | 362/197 |
| 4,750,095 | 6/1988 | Huang | 362/190 |

*Primary Examiner*—Ira S. Lazarus
*Assistant Examiner*—Peggy Neils
*Attorney, Agent, or Firm*—Saidman, Sterne, Kessler & Goldstein

[57] ABSTRACT

This invention discloses an improved flashlight assembly which comprises a lighting device, an upper housing, a lower housing, a packing member and a cap. The lighting device is disposed on the top of the upper housing for offering a beam of light when electric connection is achieved. A through hole and a pair of threads are formed respectively on the upper housing and the lower housing so that they may be engage with each other. Likewise, the packing member is also provided with a though hole and a pair of openings for attachment on the hollow joint member. A non-conductive sheet can be inserted into the flashlight body to break the electrical connection of the batteries when all through holes have been aligned in an overlayed manner due to the assembly of both the upper housing and the lower housing by the engagement of two pairs of threads. Preferably, when the upper housing is rotated in a clockwise direction with respect to the lower housing, the through hole of the upper housing will be blocked due to this displacement preventing moisture or water from infiltrating the flashlight body.

8 Claims, 3 Drawing Sheets

FLASHLIGHT ASSEMBLY

BACKGROUND OF THE INVENTION

The present invention is a CIP of an application Ser. No. 895,456, filed on Aug. 11, 1986, and now U.S. Pat. No. 4,750,095 issued June 7, 1988.

Referring to FIG. 1, a flashlight assembly of said U.S. Pat. is illustrated. It was shown that a flashlight assembly including a holder 2 and a flashlight 1, was assembled together by the insertion of the separating rod 23 of said holder 2 into a through hole 15 of the flashlight 1. In such a way, the flashlight can be turned off. If the light is needed, the user need only remove the flashlight from the holder 2 to achieve the electrical connection which turns the light on. Although, this assembly appears convenient, it is disadvantageous in consideration of the fact that said through hole 15 facilitates the infiltration of moisture or water into said flashlight body. In the event of such a moisture or water infiltration, the metal elements within the flashlight body will be damaged, greatly shortening the life of the flashlight.

SUMMARY OF THE INVENTION

Accordingly, it is a main object of this invention to provide a flashlight assembly adopting a two-section housing the sections of which can be engaged to or detached from each other, and can be alternately aligned or unaligned with a through hole for the purpose of the opening and closing of the through hole so as to prevent moisture or water from infiltrating the flashlight body.

It is another aspect of this invention to provide a packing member which is placed between the two-sections of the housing, enabling said packing member to be tightly enclosed therein, so that moisture or water cannot infiltrate the flashlight body.

A flashlight of this invention has a lighting means, and an elongated hollow housing joined with said lighting means for receiving a set of batteries which are adapted to be aligned within said elongated hollow housing, making contact singly and electrically connecting in series, constituting an electric circuit with said lighting means, said elongated hollow housing having a hole formed at a position where, when a non-conductive sheet is inserted therethrough, the electrical contact of said batteries can be broken; wherein the improvement is characterized by said elongated hollow housing comprising:

a first hollow housing having a first end and a second end, said first end being joined with said lighting means and said second end having a first hole formed therein; and a second hollow housing having a third end and a fourth end, said third end having a second hole formed therein and being adapted to rotatably join with said second end so that said second hollow housing can be joined with said first hollow housing, forming the above-mentioned elongated hollow housing, and rotated to a certain angle where said second hole is aligned with said first hole, forming the above-mentioned through hole, and said fourth end end being covered by a removable cap upon the removal of which, said set of batteries can be put into said elongated hollow housing and aligned singly so as to make electrical contact with each other.

Other objects and advantages of the invention will become apparent and be readily understood from the following description read in conjunction with the accompanying drawings, in which:

DETAILED DESCRIPTION OF THE PREFERRED EMBODIMENT

Figure 1:
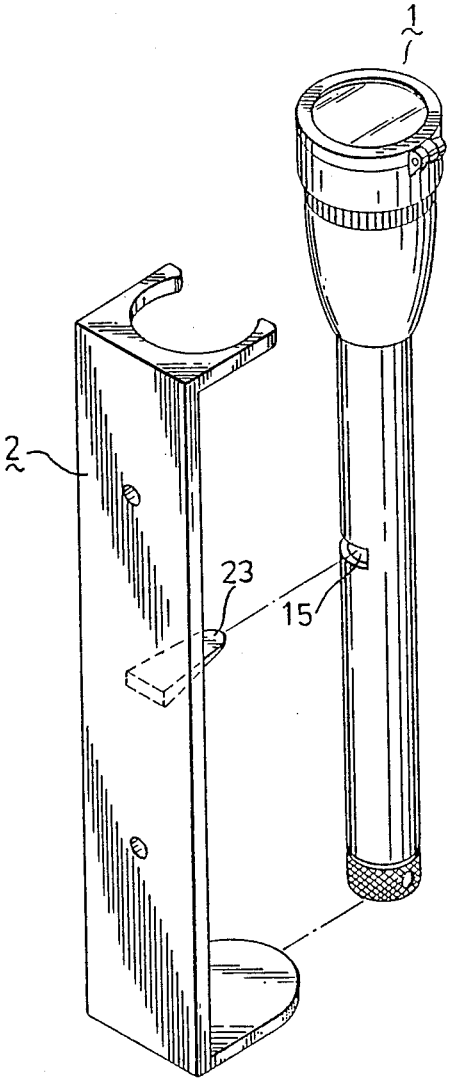
FIG.1 (PRIOR ART)
FIG. 1 is a perspective view of a known flashlight assembly.
Figure 2:
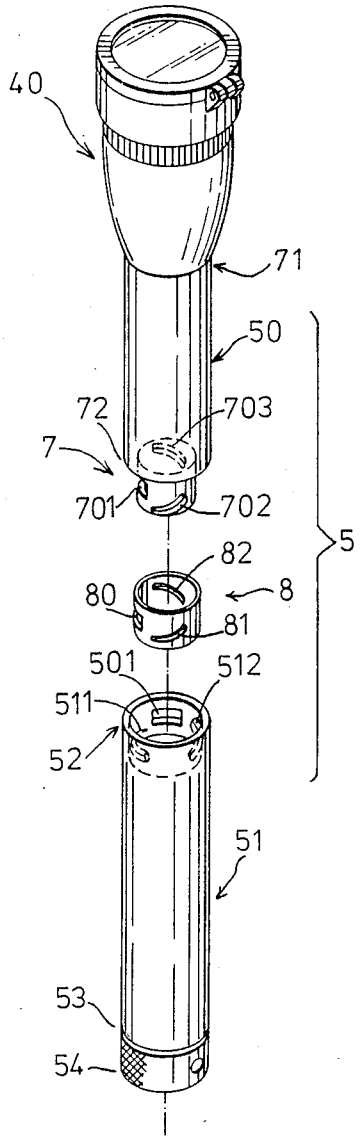
FIG. 2 is an exploded perspective view of an improved flashlight assembly according to the invention.
Figure 3:
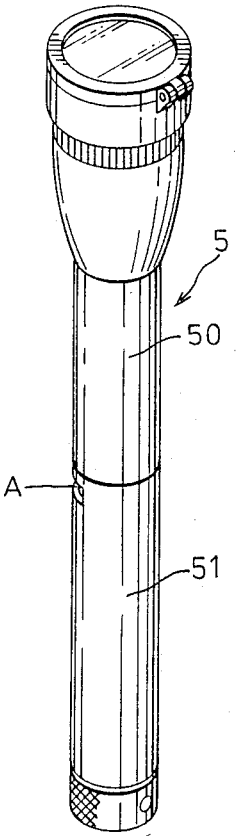
FIG. 3 is an assembled perspective view of FIG. 2 showing that a through hole has been aligned.

Referring to FIG. 2, a flashlight assembly 5 is shown. A flashlight assembly 5 generally has a lighting device 40, an elongated hollow upper housing 50 and a hollow lower housing 51. The upper housing 50 is joined with said lighting device 40 for receiving a set of batteries, (not shown), which are adapted to be aligned within said elongated hollow housings 50, 51, making contact singly and electrically connecting in series, constituting an electric circuit with said lighting device 40. The electrical contact of said batteries can be broken when a non-conductive sheet, (not shown), is aligned with and inserted into a through hole of the flashlight body. The flashlight assembly 5 includes a first hollow housing and a second hollow housing. The first hollow housing is substantially an upper housing 50, and the second hollow housing is substantially a lower housing 51. The upper housing 50 has a first end 71 and a second end 72. Whereas, the first end 71 is joined with said light device 40 and the second end 72 has a first through hole 701 formed therein. The lower housing 51 also has a third end 52 and a fourth end 53. The third end 52 has a second through hole 501 formed therein and is adapted to be rotatably joined with said second end 72 so that said lower housing 51 can be joined with said upper housing 50. When the lower housing 51 is rotated with respect to said upper housing 50 so that said second through hole 501 is aligned with said first through hole 701, the through hole "A ",(see FIG.3), is openly presented. In addition, the fourth end 53 is covered by a removable cap 54 upon the removable of which, said set of batteries can be put into said elongated hollow housings 50, 51. The batteries are thus aligned singly so as to make electrical contact with each other. Furthermore, the upper housing 50 comprises a hollow joint member 7 with said first through hole 701, axially extending from said second end 72, adapted to be inserted into and joined with said third end 52 of said lower housing 51. Whereas, the joint member 7 further comprises a packing member 8 having a third through hole 80 formed therein. The packing member 8 is tightly fixed around said joint member 7, aligning said third through hole 80 with said first hole 701, thus protecting the inside of said elongated hollow housings 50, 51 from moisture or water infiltration via the joint between said upper and lower hollow housings 50, 51. It should be noted that the hollow joint member 7 includes a pair of male threads 702, 703, disposed at its outer periphery. Said male threads 702, 703, are separately formed therefrom and placed opposite each other. The third end 52 of said lower housing 52 includes a pair of female threads 511, 512, disposed on its inner wall so as to accomodate said male threads 702, 703, of said second end of said upper housing 50 and allow rotation of the elongated hollow housings at a suitable angle. The packing member 8 includes a pair of openings 81, 82 which accomodate said male threads 701, 702, such that said packing member 8 may be tightly fastened onto the second end 72 of the upper housing 50.

Figure 4:
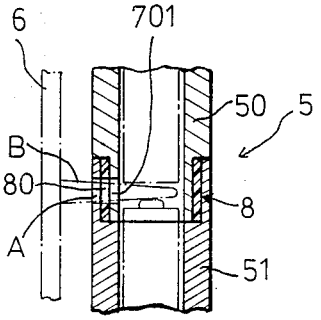
FIG. 4 is a sectional view of the aligned holes of the first hollow housing and the second hollow housing of flashlight assembly of FIG.2.
Figure 5:
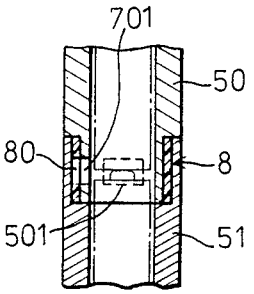
FIG. 5 is a sectional view of the unaligned holes of the first hollow housing and the second hollow housing.

FIG. 4 reveals that all through holes 701, 501, 80 have been aligned to form a main through hole "A" so that a non-conductive sheet "B" can be inserted into the flashlight body to separate the batteries and turn off the light. Referring next to FIG. 5, it is shown that the first through hole 701 of the upper housing 50 will be blocked due to a displacement of the upper and lower housings caused when the lower housing 51 rotates in a clockwise direction with respect to the upper housing 50. In this way, due to the closure of the first through hole 701, water or moisture cannot infiltrate the flashlight body.

In addition, the upper housing 50 and the lower housing 51 can be detached from the flashlight body by means of applying a force, in a counterclockwise direction, onto the lower housing 51 with respect to the upper housing 50.

Although the invention has been described in terms of certain preferred embodiments, modifications will be apparent to those skilled in the art. All such modifications are intended to be included within the scope of the following claims.

What is claimed is:

1. A flashlight comprising:

a light means;

an elongated hollow housing joined with said lighting means for receiving a set of batteries which are adapted to be aligned within said elongated hollow housing, making contact singly and electrically connecting in series, constituting an electric circuit with said lighting means, said elongated hollow housing having a hole formed at a position where, when a non-conductive sheet is inserted therethrough, the electrical contact of said batteries can be broken;

said elongated hollow housing further comprising:

a first hollow housing having a first end and a second end, said first end being joined with said lighting means and said second end having a first hole formed therein; and a second hollow housing having a third end and a fourth end, said third end having a second hole formed therein and being adapted to rotatably join with said second end so that said second hollow housing can be joined with said first hollow housing, forming the above-mentioned elongated hollow housing, and rotated to a certain angle where said second hole is aligned with said first hole, forming the above-mentioned through hole, and said fourth end being covered by a removable cap upon the removal of which, said set of batteries can be put into said elongated hollow housing and aligned singly so as to make electrical contact with each other.

2. A flashlight as claimed in claim 1, wherein said first hollow housing comprises a hollow joint member with said first hole, axially extending from said second end, adapted to insert into and join with said third end of said second hollow housing.

3. A flashlight comprising:

a lighting means;

an elongated hollow housing joined with said lighting means for receiving a set of batteries which are adapted to be aligned within said elongated hollow housing, making contact singly and electrically connecting in series, constituting an electric circuit with said lighting means, said elongated hollow housing having a hole formed at a position where, when a non-conductive sheet is inserted therethrough, the electrical contact of said batteries can be broken;

said elongated hollow housing further comprising:

a first hollow housing having a first end and a second end, said first end being joined with said lighting means and said second end having a first hole formed therein; and a second hollow housing having a third end and a fourth end, said third end having a second hole formed therein and being adapted to rotatably join with said second end so that said second hollow housing can be joined with said first hollow housing, forming the elongated hollow housing, and rotated to a certain angle where said second hole is aligned with said first hole, forming the through hole, and said fourth end being covered by a removable cap upon the removal of which, said set of batteries can be put into said elongated hollow housing and aligned singly so as to make electrical contact with each other;

wherein said first hollow housing comprises a hollow joint member, axially extending from said second end and having said first hole formed therein, adapted to insert into and join with said third end of said second hollow housing; and wherein said joint member further comprises a packing member having a third hole formed therein, said packing member being tightly fixed around said joint member, aligning said third hole with said first hole, and protecting the inside of said elongated hollow housing from the infiltration of moisture into the joint between said first and second hollow housings.

4. A flashlight as claimed in claim 3, wherein said hollow joint member includes a pair of male threads disposed at its outer periphery, said male threads being separately formed thereon, and placed opposite to each other.

5. A flashlight as claimed in claim 4, wherein said third end of said second hollow housing includes a pair of female threads disposed on its inner wall so as to accomodate said male threads of said second end of said first hollow housing and enable rotation of the elongated hollow housing at a suitable angle.

6. A flashlight as claimed in claim 5, wherein said packing member includes a pair of openings which may be fitted with said male threads such that said packing member is tightly fastened onto said second end of said first hollow housing.

7. A flashlight as claimed in claim 6, wherein the first hole of said first hollow housing will be blocked due to a displacement of the upper and lower housings caused when said second hollow housing rotates in a clockwise direction with respect to said first hollow housing.

8. A flashlight as claimed in claim 7, wherein said first hollow housing and said second hollow housing can be detached from the flashlight body by means of applying a force, in a counterclockwise direction, onto said second hollow housing with respect to said first hollow housing.

* * * * *